US011884370B2

(12) United States Patent
Reifsnyder

(10) Patent No.: US 11,884,370 B2
(45) Date of Patent: Jan. 30, 2024

(54) WATERBOARD

(71) Applicant: Adrian Pierce Reifsnyder, Honolulu, HI (US)

(72) Inventor: Adrian Pierce Reifsnyder, Honolulu, HI (US)

( * ) Notice: Subject to any disclaimer, the term of this patent is extended or adjusted under 35 U.S.C. 154(b) by 442 days.

(21) Appl. No.: 16/671,437

(22) Filed: Nov. 1, 2019

(65) Prior Publication Data

US 2021/0129947 A1 May 6, 2021

(51) Int. Cl.
*B63B 32/77* (2020.01)

(52) U.S. Cl.
CPC ..... *B63B 32/77* (2020.02)

(58) Field of Classification Search
CPC ..... B63B 32/77
See application file for complete search history.

(56) References Cited

U.S. PATENT DOCUMENTS

| | | | | |
|---|---|---|---|---|
| 4,955,835 | A * | 9/1990 | Hollingsworth | B63B 32/70 114/174 |
| 10,538,296 | B2 * | 1/2020 | Duff | B63B 32/70 |
| 2016/0229498 | A1 * | 8/2016 | Olsen | B63B 32/77 |
| 2016/0272286 | A1 * | 9/2016 | Caranto | F16M 11/2085 |
| 2018/0057123 | A1 * | 3/2018 | Gunner | F16M 11/10 |
| 2018/0178887 | A1 * | 6/2018 | Pacini | B63C 9/11 |
| 2018/0362124 | A1 * | 12/2018 | Norton | B63B 32/77 |

* cited by examiner

*Primary Examiner* — Stephen P Avila
(74) *Attorney, Agent, or Firm* — Maus & Associates

(57) ABSTRACT

A surfboard is disclosed herewith comprising an external housing and attachment means. The attachment means may comprise any known attachment technique such as receptacle means, adhesive means, suction means, screws, clamps, tongue and groove, Velcro®, or magnetic means, The housing may be of any shape but a cylindrical shape to tightly receive a standard water can and/or bottle is preferred. Said housing may be further insulated and/or have an external storage pocket.

12 Claims, 2 Drawing Sheets

WATERBOARD

FIELD OF THE INVENTION

The present invention relates generally to water boards and specifically to a surfboard comprising a storage housing.

BACKGROUND OF THE INVENTION

The present invention relates generally to water boards and specifically to surfboards comprising a permanently affixed or detachably connected housing. Water surfing often entails long wait periods for surfable waves to appear in hot and sun drenched conditions without access to food or drink or medical supply. While hydration can present an issue for many, it is especially critical for individuals with medical conditions such as diabetes 2, where lack of food intake and/or dehydration can lead to hyper or hypoglycemic shock, coma and in the extreme death. Moreover, with the increased occurrence of shark attacks, first aid storage is highly advantageous and often life saving.

Prior art surfboards do not comprise an attachment for supplies that do not interfere with the surfing dynamics. U.S. Pat. No. 4,955,835 discloses a storage capsule for surfboards housed within the surfboard itself to provide a watertight seal. While this invention advantageously allows for supply storage, its internal structure to a surfboard affects the surf dynamics.

Likewise, backpacks or holsters worn on the body, although hands free, are cumbersome and interfere in body movement and hence in the surfing dynamics.

Thus it is the primary purpose of this invention to provide for an attachment that allows for storage while not interfering in the surf dynamics.

U.S. Pat. No. 0,061,711 A1 discloses a mounting system for attaching a camera to a sports board. While this patent discloses a mounting system specific for cameras it does not address storage attachments.

The present invention advantageously allows for storage without affecting the surf dynamics.

SUMMARY OF THE INVENTION

The present invention comprises a surfboard with a permanently affixed or releasably attached housing for storage, which can withstand the forces of nature encountered in surfing while simultaneously not interfering in the surfing dynamics.

BRIEF DESCRIPTION OF THE DRAWINGS

The advantages and features of the present invention will be more fully understood from the following description of the preferred embodiments taken in conjunction with the accompanying drawings wherein.

DESCRIPTION OF THE PREFERRED EMBODIMENT

Figure 1:
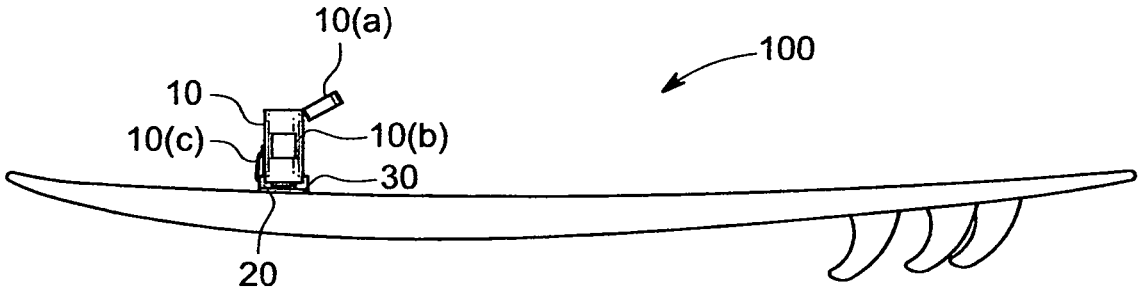
FIG. 1 is a prospective view of a surfboard comprising a preferred housing and attachment mechanism.

FIG. 1 depicts a surfboard 100, comprising a housing 10, and attachment means 20, for said housing, 10.

Housing 10 can be permanently or releasably attached to surfboard 100.

Housing 10 can be rigid or flexible, flexible to avoid injuries due to collisions during surfing yet rigid enough to retain contents in said housing while surfing. By way of illustration and not limitation, flexible materials such as shape polymers with retention memory are preferred. Housing 10, can further be insulated with any conventional insulation material. Housing 10 may be of any shape but a cylindrical shape to tightly receive standard water can(s) and/or bottle(s) is preferred. Thus in one preferred embodiment, housing 10 is approximately 4-8 inches in height and 4-8 inches in diameter. Still further housing 10 may comprise a lid, 10(*a*). Lid 10(*a*) may be secured with any conventional closure mechanism including but not limited to zipper(s), button, (s), weighted material, Velcro®, magnetic, etc. If magnetic, the top of housing 10 comprises a receiving magnet. Still further housing 10 may comprise an external or internal pocket (10 *b*) for storage of smaller items such as medicine, bandages, tourniquet, etc. Pocket 10 (*b*) may be comprised of any commercially available material, but water resistant material is preferred, by way of illustration and not limitation, rubber, polyvinyl chloride, polyurethane, silicone, polymers, etc. Pocket 10(*b*) may be any size or dimension. Accordingly, in one embodiment, pocket 10(*b*) may be expandable by comprising elastic and or accordion sides. Still further, housing 10 may be further secured to surfboard, 100, with a tether, 10(*c*).

Figure 2:
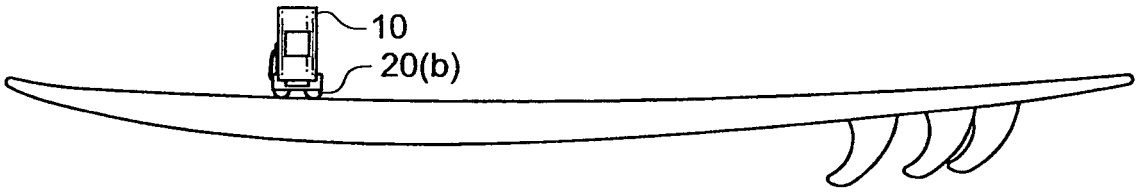
FIG. 2 is an exploded view of a housing and second attachment embodiment.
Figure 3:
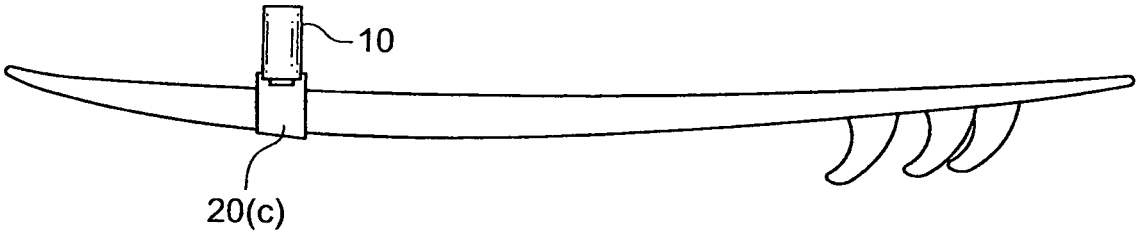
FIG. 3 is an exploded view of a housing and third attachment embodiment.

Attachment means 20 may comprise any known attachment technique. By way of illustration and not limitation, receptacle means, adhesive means, suction means, screws, clamps, tongue and groove, hook and loop fasteners, better known under the trade name Velcro® and hereinafter referred to by Velcro; magnetic means, etc. FIGS. 1,2, and 3 depict adhesive, suction cup, and clamp embodiments respectively. Attachment mechanism 20 may be permanently affixed to surfboard 100 or releasably attached to a mounting layer, 30, placed between attachment, 20, and surfboard, 100. Said mounting layer may be manufactured from any known material so long as it is compatible with surfboard 100 and housing 10 material, and allows for mounting to surfboard 100 and housing 10.

Attachment means 20 may comprise any conventionally known adhesive but a water resistant adhesive is preferred. By way of illustration and not limitation, epoxies, silicones, polyurethanes, polysulfide's and UV curable adhesives are preferred. Said adhesive may also be in the form of a double sided tape applied to the bottom of housing 10, to releasably bond to surfboard 100.

Similar to double sided tape, attachment means 20 may comprise Velcro® wherein the first Velcro® layer is applied to the bottom of housing 20, to engage with a second receiving Velcro® layer adhered directly to surfboard 100, or indirectly to a mounting layer, 30, to attach to surfboard 100.

Still further attachment means may comprise magnetism. Opposing magnetic pieces are adhered to the bottom of housing 10 and surfboard 100 directly or via mounting layer, 30, to form a releasably tight bond between housing 10 and surfboard 100.

Attachment mechanism 20 may further comprise 1 or more suction means. Said suction means may comprise any shape. By way of illustration and not limitation, FIG. 2 depicts suction cups 20 (*b*) adhered to the bottom of housing, 10. Notably, said suction cups function best when adhered to the bottom of housing 10, if housing 10, is made of a relatively rigid material. If housing 10 is manufactured from flexible material, then the suction mean(s) are applied to the surfboard, 100, directly. Said suction means 20(*b*) may be manufactured from any known material and may take on any shape or size, yet less than 0.5 inches in height is preferred so as not to provide a large surface area for wind and water to sway housing 10.

Attachment means 10 may also comprise one or more clamping means, 20 (*c*) in FIG. 3. Clamp 20(*c*) may be manufactured from any conventionally known clamping material, polymer-coated clamps being preferred to resist rusting. If the material itself is not water resistant then by way of illustration and not limitation, a polyurethane coating may be applied. If housing 10, is made of rigid material, clamping means 20(*c*) may be releasably or permanently affixed to the bottom of housing 10.

Figure 4:
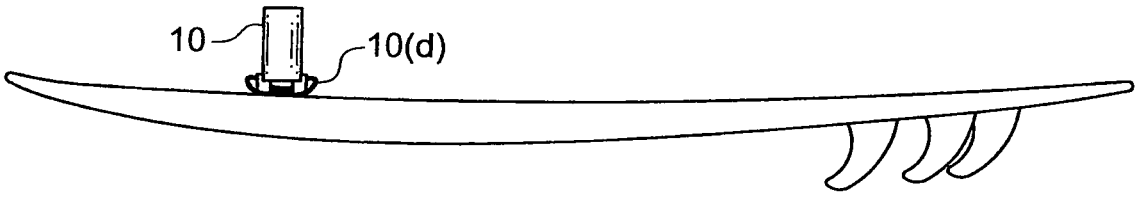
FIG. 4 is an exploded view of a housing and fourth attachment embodiment.

Receptacle means, 10(*d*), FIG. 4, may comprise a tight fitting receptacle adhered to surfboard 100, to receive housing 10. Said receptacle being tight enough to safely secure the contents of housing 10, in place on surfboard 100. By way of illustration and not limitation receptacle 40, may be manufactured from any conventionally known material compatible with surfboard materials, yet any of the known elastomeric polymers are preferred. In a preferred embodiment receptacle 10 (*d*) is slightly larger in diameter than housing 10 so as to cup and secure housing 10 securely.

Still further attachment means 20 may comprise a tongue and groove mechanism wherein an extended element (tongue) on one surface, securely yet releasably engages with a groove on an opposing surface. The tongue may be located on the surfboard or housing 20 and the groove may be located on the surfboard or housing 20, as long as they are on opposite surfaces so as to releasably engage.

In a further embodiment, attachment mechanism 20 is extendable. Mechanism 20, may comprise extendable arms or footings so as to enable housing 10 to be moved anywhere along the width or length of the board to accommodate surfing. Said extendable arms or footings are to be securely located within attachment means 20. While housing 10 may be located anywhere on surfboard 100, in the preferred embodiment housing 10, is located near the front end of surfboard 100, so as to least interfere in foot positioning.

Since certain changes may be made without departing from the scope of the invention as described herein, it is intended that all matter described in the foregoing specification, including the drawings, shall be interpreted as illustrative and not in a limiting sense.

I claim:

1. An accessory mounting system for a water board comprising an external housing and attachment means;

the external housing is cylindrical and formed of a flexible polymer with shape retention memory, shaped to tightly receive a standard water bottle or can, the external housing being approximately 4-8 inches high and 2-6 inches in diameter, the external housing forming a waterproof enclosure, the external housing including external and internal extendable pockets;

the attachment means to enable the external housing to be moved along the width and length of the water board to accommodate surfing, the attachment means secures the external housing to the water board;

the external housing further includes a tether; and, the external housing and attachment means being located on the top front of the water board to least interfere with foot positioning while surfing.

2. An accessory mounting system for a water board comprising an external housing and attachment means;

the external housing is cylindrical and formed of a flexible polymer with shape retention memory, shaped to tightly receive a standard water bottle or can;

the external housing being approximately 4-8 inches high and 2-6 inches in diameter, attachment means to secure the external housing to the water board and enable the external housing to be moved along the width and length of the water board to accommodate surfing;

the external housing further includes a tether; and, the external housing and attachment means being located on the top front of the water board to least interfere with foot positioning while surfing.

3. The accessory mounting system for a water board of claim 2, wherein the external housing is collapsible.

4. An accessory mounting system of claim 3, wherein the external housing is collapsible to the surface of the water-board when not in use.

5. The accessory mounting system of claim 3, wherein the external housing further comprises internal and/or external pockets.

6. The accessory mounting system of claim 5, wherein the external housing further comprises extendable internal and/or external pockets.

7. The accessory mounting system of claim 2, wherein the attachment means are receptacle means, adhesive means, suction means, screws, clamps, tongue and groove, hook and loop or magnetic means.

8. The accessory mounting system of claim 3, wherein the attachment means are receptacle means, adhesive means, suction means, screws, clamps, tongue and groove, hook and loop or magnetic means.

9. The accessory mounting system of claim 7, wherein the attachment means is an extendable clamp.

10. The accessory mounting system of claim 3, wherein the attachment means is an adhesive placed along the width and/or length of the top front of the water board for adjusting the placement of the housing to least interfere with foot positioning while surfing.

11. The accessory mounting system of claim 3, wherein the attachment means is a hook and loop placed along the width and/or length of the top front of the water board for adjusting the placement of the housing to least interfere with foot positioning while surfing.

12. The accessory mounting system of claim 3, wherein the attachment means is magnetic placed along the width and/or length of the top front of the water board for adjusting the placement of the housing to least interfere with foot positioning while surfing.

* * * * *